US008813956B2

(12) United States Patent
Superti

(10) Patent No.: US 8,813,956 B2
(45) Date of Patent: Aug. 26, 2014

(54) CONTAINER WITH SIDE OPENING

(75) Inventor: Jarbas Superti, Brent-Montreux (CH)

(73) Assignee: Philip Morris USA Inc., Richmond, VA (US)

( * ) Notice: Subject to any disclaimer, the term of this patent is extended or adjusted under 35 U.S.C. 154(b) by 782 days.

(21) Appl. No.: 12/970,682

(22) Filed: Dec. 16, 2010

(65) Prior Publication Data

US 2011/0147242 A1 Jun. 23, 2011

(30) Foreign Application Priority Data

Dec. 16, 2009 (EP) ..... 09179448

(51) Int. Cl.
*B65D 85/10* (2006.01)

(52) U.S. Cl.
USPC ..... 206/249; 229/159

(58) Field of Classification Search
USPC ..... 206/242, 249, 250, 251; 229/126, 155, 229/159
See application file for complete search history.

(56) References Cited

U.S. PATENT DOCUMENTS

| | | | | |
|---|---|---|---|---|
| 2,847,153 | A | 8/1958 | Guyer et al. | |
| 3,102,675 | A * | 9/1963 | Schrom | 206/251 |
| 3,360,114 | A | 12/1967 | Blum | |
| 3,404,829 | A * | 10/1968 | Stone | 229/148 |
| 4,714,082 | A | 12/1987 | Banerjee et al. | |
| 5,074,462 | A * | 12/1991 | Countee, Jr. | 229/155 |
| 5,692,525 | A | 12/1997 | Counts et al. | |
| 6,386,441 | B2 * | 5/2002 | Philips | 229/143 |

FOREIGN PATENT DOCUMENTS

| | | |
|---|---|---|
| CH | 543 860 | 11/1973 |
| EP | 1 500 597 A1 | 1/2005 |
| WO | WO 99/48391 | 9/1999 |

OTHER PUBLICATIONS

International Search Report and Written Opinion mailed Feb. 7, 2011 for International Application No. PCT/EP2010/069809.

Search Report dated May 3, 2010 for European Patent Application No. 09179448.7-2308.

* cited by examiner

*Primary Examiner* — Jacob K Ackun

(74) *Attorney, Agent, or Firm* — Buchanan Ingersoll & Rooney PC

(57) ABSTRACT

A container for consumer goods includes a top wall, a bottom wall, a front wall, a back wall and two side walls. One of the two side walls is pivotally attached to either the back wall or the front wall so as to be capable of being actuated in a manner such as to be moved between an open position and a closed.

5 Claims, 4 Drawing Sheets

CONTAINER WITH SIDE OPENING

CROSS-REFERENCE TO RELATED APPLICATION

This application corresponds to and claims priority under 35 U.S.C. §119 to European Application No. 09179448.7, filed Dec. 16, 2009, the entire content of which is hereby incorporated by reference.

WORKING ENVIRONMENT

Various types of containers made from folded laminar blanks are contemplated in the field of packaging for consumer goods. Two types of containers for smoking articles are the "hinge lid pack" and the "soft-pack". The smoking articles can be accessed and removed by the consumer through an opening at the top of the container of both types of containers. For the hinge lid pack, the consumer can access and remove the smoking articles by pivoting the hingedly attached lid. Once the lid is pivoted to its open position, it is possible to access a plurality of the smoking articles contained in the container. For the "soft-pack" the top wall of the container, which is that wall that is arranged on top of the container when the container is held in its upright position, is at least partially removed so as to create an opening through which the consumer can access and remove the smoking articles. It is possible to have access to a plurality of smoking articles contained in the container by creating a large opening in the top wall.

SUMMARY OF SELECT FEATURES OF THE PREFERRED EMBODIMENT

A side opening container for consumer goods finds particular application as a container for smoking articles such as cigarettes. In a preferred embodiment, the side opening container includes a front wall, a back wall, a top wall, a bottom wall, and two side walls. Preferably, one of the two side walls is pivotally attached to either the back wall or the front wall of the container and is capable of being moved between an open position and a closed position.

In the preferred embodiment, the side wall which is capable of being moved includes separate first and second side wall portions which are separated from one another in a manner such that each of the first and second side wall portions includes approximately half of the side wall. Preferably, the other one of the two side walls is fixedly attached to the front wall or to the back wall of the container.

Also preferably, first side wall portion is provided with a retaining means allowing the second side wall portion to remain in the closed position. Moreover, the first side wall portion includes an overlapping cut-out portion and a back wall portion arranged behind the cut-out portion so that the interior of the container is fully closed when the second side wall portion is in the closed position. In the preferred embodiment, the second side wall portion includes an extension portion which is located towards the inside of the container and which is pivoted together with the second side wall portion, so that it extends into the interior of the container and allows a smoking article to come to lie thereon as the second side wall portion is in the closed position. Preferably, the extension portion also moves the smoking article along with it during pivoting of the second side wall portion from the closed position to the open position thus releasing the smoking article from the interior of the container.

In the preferred embodiment, the side wall which is capable of being actuated is pivotally attached to the front wall or to the back wall and includes a continuous side wall portion and an extension portion which extends towards the interior of the container. Preferably, the continuous side wall portion has a laterally attached flap at one end. Also preferably, the extension portion is provided with laterally attached guiding elements for internal guiding of the extension portion. Moreover, during pivotal movement of the continuous side wall portion to the open position a smoking article is prevented from falling out one end because of the laterally attached flap. Preferably, during pivotal movement of the continuous side wall portion the extension portion is moved along the top wall or bottom wall while being internally guided by the guiding elements.

Also in the preferred embodiment, the back wall or front wall contains a cut-out, which is located on the front wall or back wall opposite to the back wall or front wall to which the continuous side wall portion is pivotally attached. Preferably, the side wall which is capable of being actuated is adapted to allow only one single article at a time to be released from the interior of the container. Also preferably, the container is formed of a single, rigid piece of cardboard or of a laminar material or the like. Moreover, the container contains smoking articles.

BRIEF DESCRIPTION OF THE DRAWINGS

The invention will be further described, by way of example only, with reference to the accompanying drawings wherein like reference numerals are applied to like elements and wherein.

DETAILED DESCRIPTION

Figure 1:
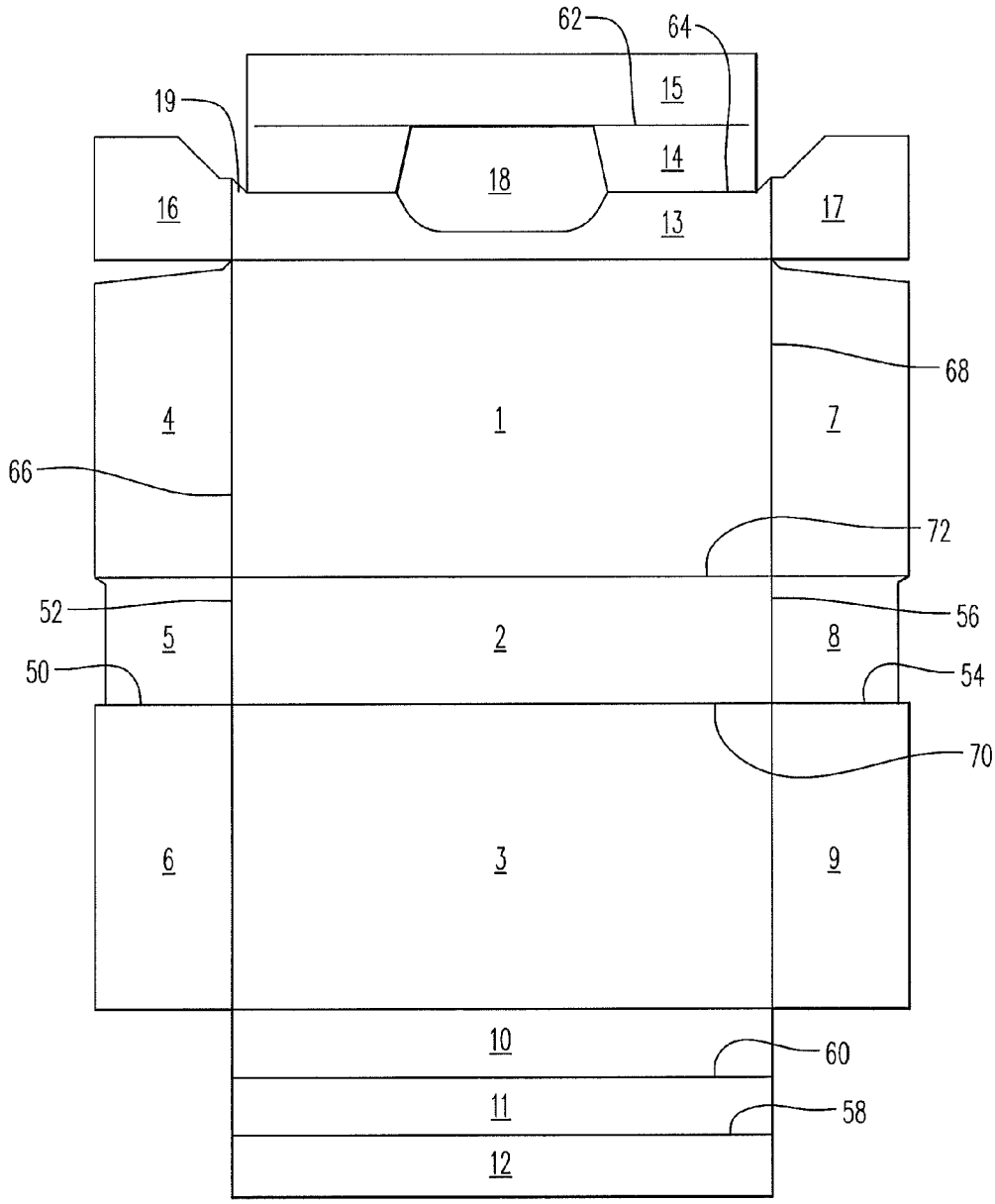
FIG. 1 shows a plan view of a first embodiment of the container prior to cutting, folding and gluing.

A novel container for consumer goods in general, which is particularly suitable for smoking articles is provided. Although the following disclosure refers to the use of the container in the field of smoking articles by way of example, the container can be used for consumer goods other than smoking articles.

In a preferred embodiment, the container includes a front wall, a back wall, a top wall, a bottom wall and two side walls. One of the said two side walls is capable of being actuated in a manner such as to be moved between an open position and a closed position while being pivotally attached to either the back wall or the front wall of the container. In the closed position, the side wall prevents the release of a smoking article. In the open position, the side wall allows for the release of a smoking article from the interior of the container.

It is to be understood that the terms top wall, bottom wall, front wall, back wall, and side wall refer to the respective walls of the container when the container is held in its upright position. In the said upright position of the container for consumer goods, the longitudinal direction of the front wall, of the back wall, and of the side walls of the container corresponds to the longitudinal direction of the smoking articles when they are arranged inside the container. The side walls are those walls having a width which is smaller than that of the front wall and the rear wall, respectively.

In particular, the container may be a rectangular container and one of the side walls which is capable of being actuated is most commonly one of the side walls of the rectangular container.

As further described, in some embodiments, one of the side walls is capable of being actuated and is adapted to allow only one smoking article at a time to be released from the interior of the container. Releasing one smoking article at a time is convenient for the consumer. When in the second, or open, position, the further described embodiments prevent release of more than one smoking article at a time, and in particular prevent additional smoking articles contained in the interior of the container from falling out.

In the preferred embodiment of the container, the one of the side walls which is capable of being actuated includes separate first and second side wall portions. Preferably, the first and second side wall portions are separated from one another in a manner such that each of the side wall portions includes approximately half of the side wall. Also preferably, the first side wall portion is fixedly attached to the front wall or to the back wall of the container. Moreover, the second side wall portion is pivotally attached to the back wall or to the front wall of the container so as to be pivoted between the open and closed position.

In the preferred embodiment, the first side wall portion can be provided with a retaining means allowing the second side wall portion to remain in the closed position. This allows the first side wall to retain the second side wall portion in the closed position of the container. Accordingly, when the container is in the closed position it must be actively actuated and opened by the consumer to obtain a smoking article contained in the container. In the closed position, the first and second side walls prevent unintentional loss of the smoking articles from the container and provide for some protection of the smoking articles against potential adverse environmental effects.

Also in the preferred embodiment, the first side wall may also include an overlapping cut-out portion and a back wall portion arranged behind the cut-out portion. This enables the container to be fully closed when the second side wall portion is in the closed position. The cut-out portion in the first side wall portion allows a consumer to better grab the pivotally attached second side wall portion and pivot it from the closed position to an open position. The back wall portion behind the cut-out portion ensures that the fixedly attached first side wall portion always is closed towards the interior of the container and thus ensures that the opening generated by the cut-out does not expose the contents of the container.

Also in the preferred embodiment, the second side wall portion may include an extension portion which is located towards the inside of the container and which is pivoted together with the second side wall portion. Preferably, the extension portion extends into the interior of the container and allows a smoking article to come to lie thereon as the second side wall is in the closed position. The extension portion retains this smoking article thereon during pivoting of the second side wall portion from the closed position to the open position. As the second side wall portion along with the extension portion is pivoted from the closed position to the open position, the extension portion moves the smoking article along with it and releases the smoking article from the interior of the container. The extension portion thus makes it convenient for the consumer to more easily access the smoking articles within the container.

In an alternative embodiment, the one of the side walls which is capable of being actuated is pivotally attached to the front wall or to the back wall and includes a continuous side wall portion and an extension portion which extends towards the interior of the container. Preferably, the continuous side wall portion has a laterally attached flap at one end. Also preferably, the extension portion is provided with laterally attached guiding elements for internal guiding of the extension portion. In the closed position, a smoking article cannot be released from the interior of the container. In the open position, a smoking article is accessible on the continuous side wall portion. During pivotal movement of the continuous side wall portion to the open position a smoking article is prevented from falling out one end because of the laterally attached flap. In this manner, the release of a smoking article from the interior of the container can be done. During the pivotal movement of the continuous side wall portion, the extension portion is moved along the top wall or bottom wall while being internally guided by the guiding elements.

This alternative embodiment also conveniently releases one or more smoking articles, particularly one smoking article, from the interior of the container. As the continuous side wall portion is pivotally moved from the closed position to the open position, the extension portion is moved only a short distance. This movement is internally guided by the guiding elements. In addition, the continuous side wall portion and the extension portion are only moved to an extent that the additional laterally attached flap prevents a smoking article from falling out at one side. The smoking article can be accessed by the consumer through an opening which is created by the pivoting of the side wall portion located opposite of the laterally attached flap. For example, once the smoking article has come to lie on the continuous side wall portion, the container can be turned by the consumer in a manner such that the smoking article may slide through the opening at the side opposite the laterally attached flap. The consumer is then able to conveniently grab the smoking article.

In a variant of this alternative embodiment, the back wall or front wall may contain a cut-out. The cut-out is located on the opposite front or back wall which is used to pivot the continuous side wall. The cut-out enables a consumer to more easily grab and move the extension portion which pivots the continuous side wall portion. This movement causes the container to change from a closed position to an open position. This cut-out further improves the user friendliness of the container, since the extension portion can be grabbed more conveniently.

In another embodiment of the container, the one of the side walls which is capable of being pivoted can also be removably attached to the front wall or to the back wall of the container. This is a practical method of how the container can be opened and closed at the one of the side walls.

In the preferred embodiment, the container can be produced from a single, rigid piece of cardboard or of a laminar material or the like. Thus, the expense for the manufacturing can be kept small since assembly and attachment of a plurality of separate pieces can be avoided during production of the container. This advantage is evident when observing the specific embodiments described above.

Preferably, the container may be in the shape of a rectangular parallelepiped, with right-angled longitudinal and right-angled transverse edges. Alternatively, the container may include one or more generally rounded longitudinal edges, generally rounded transverse edges, generally beveled longitudinal edges or generally beveled transverse edges, or combinations thereof. For example, the container according to the invention may include, without limitation:

- One or two longitudinal generally rounded or generally beveled edges on the front wall, and/or
- One or two longitudinal generally rounded or generally beveled edges on the back wall.
- One or two transverse generally rounded or generally beveled edges on the front wall, and/or
- One or two transverse generally rounded or generally beveled edges on the back wall.
- One longitudinal generally rounded edge and one longitudinal generally beveled edge on the front wall, and/or
- One transverse generally rounded edge and one transverse generally beveled edge on the back wall.
- One or two transverse generally rounded or generally beveled edges on the front wall and one or two longitudinal generally rounded or generally beveled edges on the front wall.
- Two longitudinal generally rounded or generally beveled edges on a first side wall or two transverse generally rounded or generally beveled edges on the second side wall.

Where the container includes one or more generally rounded edges and is made from a laminar blank, preferably the blank includes three, four, five, six or seven scoring lines or creasing lines to form the rounded edge in the assembled container. The scoring lines or creasing lines may be either on the inside of the container or on the outside of the container. Preferably, the scoring lines or creasing lines are spaced apart from each other by a distance ranging from about 0.3 mm to about 4 mm.

Preferably, the spacing of the creasing lines or scoring lines is in function of the thickness of the laminar blank. Preferably, the spacing between the creasing lines or scoring lines is between about 0.5 and about 4 times larger than the thickness of the laminar blank.

Where the container includes one or more generally beveled edges, preferably the one or more edges have a width ranging from about 1 mm to about 10 mm, preferably ranging from about 2 to about 6 mm. Alternatively, the container may include a double bevel formed by three parallel creasing lines or scoring lines that are spaced apart such that two distinct bevels form on the edge of the container.

In yet another embodiment, the container may have, for example, a polygonal cross section such as triangular, quadrangular or hexagonal, or a cross section which is oval, semi-oval, circular or semi-circular.

Where the container includes a beveled edge and is made from a laminar blank, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel extends further into the first wall of the container than into the second wall of the container.

The container may also be formed from any suitable materials including, but not limited to, cardboard, paperboard, plastic, metal, or combinations thereof. Preferably, the cardboard has a weight ranging from about 100 grams per square meter to about 350 grams per square meter.

In the preferred embodiment, the container may be used as a package for a variety of consumer goods. In a particularly preferred embodiment, the container may be used to package smoking articles. Moreover, the container may be advantageously used to package smoking articles including, but not limited to, known lit-end cigarettes, cigars or cigarillos, heated smoking articles including a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

Through an appropriate choice of the dimensions thereof, the container may be designed to hold different total numbers of smoking articles, or different arrangements of smoking articles. For example, through an appropriate choice of the dimensions, the container may be designed to hold a total of about ten to about thirty smoking articles.

In the preferred embodiment, the container may hold one, two, three four or five separate bundles of consumer goods. The separate bundles may be arranged substantially parallel to the front wall and to the back wall or substantially perpendicular to the front wall and to the back wall.

Within a bundle, the smoking articles may be arranged in different collations, depending on the total number of smoking articles, the dimensions of the smoking articles or the cross sectional shape of the container. For example, the smoking articles may be arranged in a bundle in a single row of five, six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five, six, seven, eight, nine, or ten; or four rows of four, five, six or seven. Alternatively, the two or more rows may include at least two rows containing different numbers of smoking articles to each other.

For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

In the preferred embodiment, the container may hold smoking articles of the same type or brand, or of different types or brands. In addition, both filterless smoking articles and smoking articles with various filter tips may be contained, as well as smoking articles of differing length (for example, ranging from about 40 mm to about 180 mm), diameter (for example, ranging from about 4 mm to about 9 mm). In addition, the smoking articles may differ in strength of taste, resistance to draw and total particulate matter delivery. Where the container includes more than one bundle, each bundle within the same container may hold the same or different types of smoking articles as listed above.

Preferably, the dimensions of the container are adapted to the length of the smoking articles, and the collation of the smoking articles. Typically, the outer dimensions of the container range from about 0.5 mm to about 5 mm larger than the dimensions of the bundle of smoking articles housed inside the container.

Preferably, the container has a height ranging from about 60 mm to about 150 mm, more preferably a height ranging from about 70 mm to about 125 mm, wherein the height is measured from the top wall to the bottom wall of the container.

Preferably, the container has a width ranging from about 12 mm to about 150 mm, more preferably a width ranging from about 70 mm to about 125 mm, wherein the width is measured from the first side wall to the second side wall of the container.

Also preferably, the container has a depth ranging from about 6 mm to about 100 mm, more preferably a depth ranging from about 12 mm to about 25 mm wherein the depth is measured from the front wall to the back wall of the container (including the hinge between box and lid).

Preferably, the ratio of the height of the container to the depth of the container ranges from about 0.3 to 1 to about 10 to 1, more preferably from about 2 to 1 to about 8 to 1, and most preferably from about 3 to 1 to about 5 to 1.

Moreover, the ratio of the width of the container to the depth of the container ranges from about 1 to 1 to about 10 to 1, more preferably from about 2 to 1 and about 8 to 1, and most preferably from about 2 to 1 and 3 to 1.

Also preferably, the ratio of the height of the lid back wall to the height of the box back wall ranges from about 0 to 1 (hinge located at the top edge of the container) to about 1 to 1, more preferably about 1 to 5 to about 1 to 10, and most preferably about 1 to 6 to about 1 to 8.

Preferably, the ratio of the height of the lid front wall to the height of the box front wall ranges from about 1 to 0 (lid covering the entire front wall) to about 1 to 10, more preferably about 1 to 1 to about 1 to 5, and most preferably about 1 to 2 to about 1 to 3.

In the preferred embodiment, the exterior surfaces of the container may be printed, embossed, debossed or otherwise embellished with manufacturer or brand logos, trade marks, slogans and other consumer information and indicia. Alternatively, or in addition, the exterior surfaces of the container may be at least partially covered with lacquer, metallization, holograms, luminescent material, or any other materials that alter the feel, odor or appearance of the container.

Where the inner housing of a container according to the present invention contains one or more bundles of smoking articles, the smoking articles are preferably wrapped in an inner liner of, for example, metal foil or metallized paper.

Where the container includes smoking articles, the container may further include waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container, or combinations thereof.

Once filled, the container may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where the container is over wrapped, the over wrap may include a tear tape. The tear tape is preferably positioned around the container below the lower edge of the front wall of the lid, such that once the tear tape has been removed, the lid is free to be rotated about the first hinge line. Alternatively, the tear tape may be provided lengthways around the container.

Figure 2:
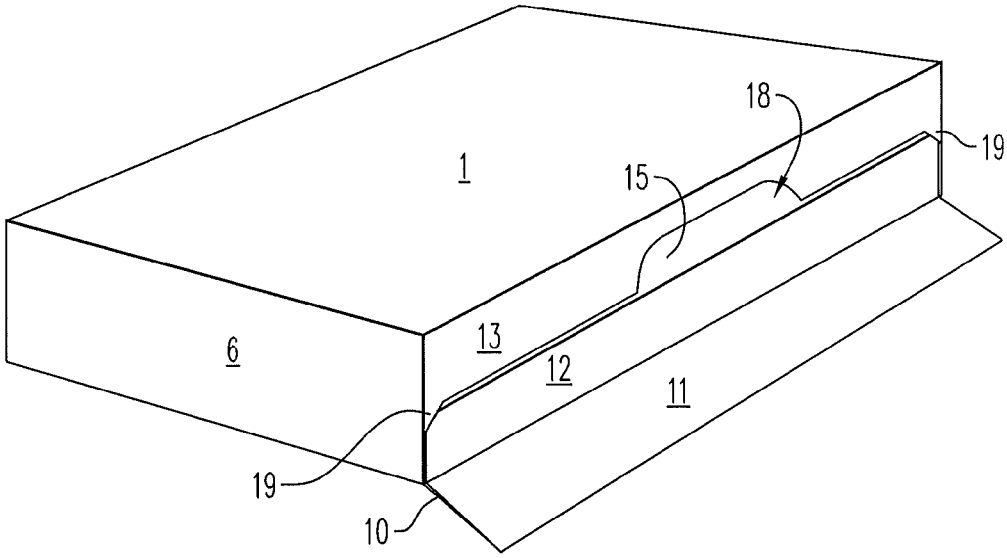
FIG. 2 shows a perspective view of the first embodiment of the container in its open state, after the cardboard has been cut, folded and glued.
Figure 3:
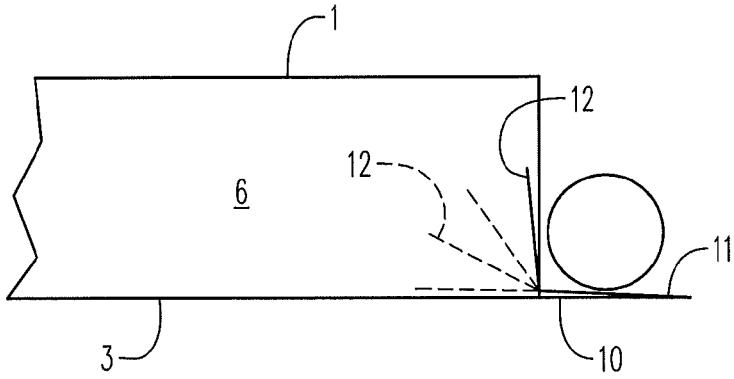
FIG. 3 schematically illustrates how a single smoking article is captured by the extension portion and is released from the interior of the container through the pivotal movement of the side wall portion to which the extension portion is attached.

FIGS. 1-3 show the preferred embodiment of the container. FIG. 1 shows the single piece of cardboard from which the container is made prior to cutting, folding and gluing, FIG. 2 shows a perspective view of the container after having been cut, folded and glued, and FIG. 3 shows how a single smoking article is released from the interior of the container.

The elements of the single piece of cardboard shown in FIG. 1 have been assigned reference numbers 1-17 while a cut-out 18 is provided between elements 13,14. The various lines indicate folding lines, along which the cardboard is folded as will be described below, and in addition the cardboard is cut along the lines 50, 52 between elements 5, 6 and 5, 2, as well as along the lines 54, 56 between the elements 8, 9 and 8, 2.

Folding and gluing is performed as follows: element 12 is folded along the horizontal line 58 between elements 11,12 towards the rear (but is not glued); element 11 is folded along the line 60 between elements 10,11; and, the front face of element 10 is glued to the front face of element 11, which faces towards the front face of element 10 after having been folded. Accordingly, elements 10,11 together form one half of one of the side walls of the container after having been glued.

In a similar manner, element 15 is folded along the line 62 between elements 14,15 towards the rear and is glued to the rear face of element 14 to create common element 14,15. Common element 14,15 is then folded along the line 64 between elements 13,14 towards the front face of element 13, and the front face of element 14 (now common element 14,15) is glued to the front face of element 13 so as to form the other half of the side wall.

Elements 4, 5, 6, 16 at the left hand side are then folded along their longitudinally extending folding line 66 so that they project upwardly. Elements 7, 8, 9, 17 at the right hand side are then folded along their longitudinally extending folding line 68 so that they also project upwardly. The cardboard is then folded along it horizontal lines 70, 72 between the elements 2, 3 and 1, 2. After this, the elements 5, 8 are folded inwardly by ninety degrees and are glued against the front face of element 2 to form the other side wall of the container.

Also, the rear faces of the elements 4, 7 are glued to the front faces of the elements 6,9, so that the rear faces of the elements 6, 9 form the outer faces of the short side walls of the container. The two flap-like elements 16, 17 are folded inwardly and their rear faces are glued to the front faces of the elements 4, 7. After these folding and gluing steps have been performed the container appears as shown in FIG. 2, from which portions 19 become apparent the function of which will be explained in more detail below.

FIG. 3 shows the container in a state in which a single smoking article is already released from the interior of the container. The way this can be achieved is as follows. In the closed position, elements 10, 11 which are glued to one another are in an upright position and the top corners of the two glued elements 10, 11 are retained in a manner similar to a snap fit behind portions 19 so that unintentional release of a smoking article from the interior of the container may not occur. Element 12 is then in its lowermost position shown in dashed lines in FIG. 3, that is to say in the position where element 12 abuts against the bottom of the container formed by element 3. As the consumer inclines the container a smoking article, e.g. a cigarette, rolls onto element 12. To release the smoking article lying on element 12, the consumer may put his forefinger through cut-out 18 (shown in FIG. 2) to engage element 11. Upon pivoting element 11 which is glued to element 10, element 12 moves in the manner shown by the dashed lines in FIG. 3 until it is finally in an upright position. Through this pivotal movement, the smoking article finally rolls onto element 11 (shown in FIG. 3). The smoking article can then be conveniently grabbed by the consumer and the container can be closed again by making the reverse pivotal movement and making the lateral outer ends of the glued elements 10,11 snap behind portions 19.

Accordingly, from FIGS. 2 and 3 it can be seen that after folding and gluing of the cardboard shown in FIG. 1, element 1 forms the front wall of the container and element 3 forms the back wall of the container. Elements 7, 9 (shown in FIG. 1) together form the top wall and elements 4, 6 together form the bottom wall of the container. One of the side walls is formed by element 2 whereas the other side wall is formed by first and second side wall portions. The first side wall portion which is fixedly attached to the top wall includes elements 13, 14, 15 and is provided with an overlapping cut-out portion 18 and back wall portion 15, with the back wall portion 15 being arranged behind the cut-out portion 18, so that the interior of the container is fully closed when the second side wall portion is in the closed position. The second side wall portion is pivotally attached to the back wall 3 and includes elements 10, 11, 12. Element 12 forms an extension portion which is located towards the interior of the container, as can be seen best in FIG. 3. In the closed position, the portions 19 retain the second side wall portion so that it remains in the closed position. Elements 1, 8, 16, 17 are not described in detail here as being part of a specific wall, although they are also glued to elements forming one of the respective walls. For obtaining a smoking article such as a cigarette, the consumer puts his forefinger through cut-out 18 and pivots second side wall portion as has been described above so as to expose a smoking article, as this is shown in FIG. 3.

Figure 4:
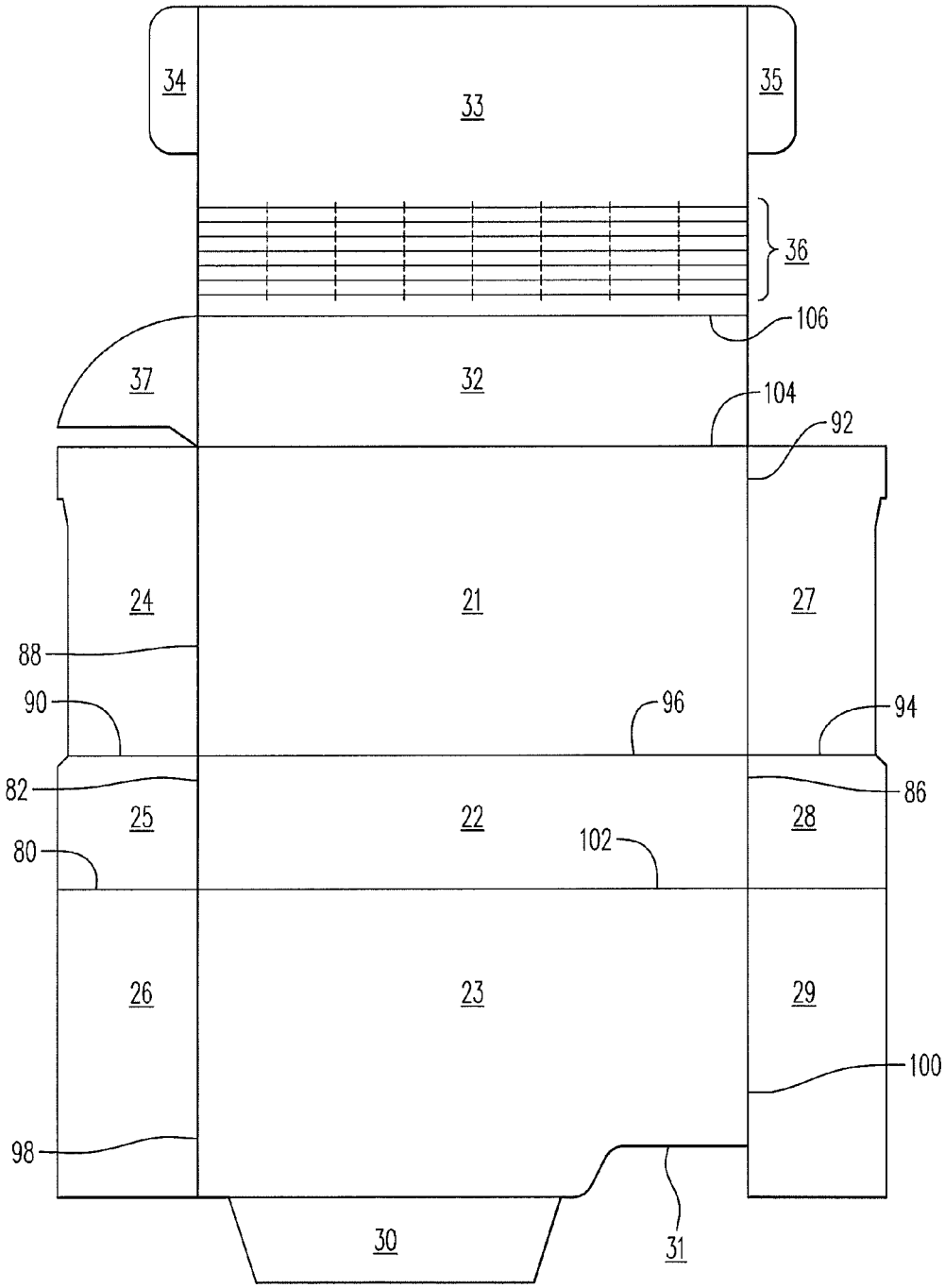
FIG. 4 shows a plan view of a single piece of cardboard or laminar material or the like of a second embodiment of the container prior to cutting, folding and gluing.

FIG. 4 shows the plan view of the single piece of cardboard of a second embodiment of the container prior to cutting, folding and gluing. Prior to folding and gluing the single piece of cardboard is cut along the lines 80, 82, 84, 86 between elements 25, 26, between elements 25, 2, between elements 28, 29, and between elements 28, 22.

Folding and gluing is then performed as follows: elements 24, 25 are bent upwardly by bending element 24 upwardly along the line 88 between elements 24, 21. In addition, element 25 is bent along the line 90 between elements 25, 24, and since elements 24, 25 have already been bent upwardly in the previous step, this results in element 25 being bent inwardly so that it extends in the direction along the line between elements 21, 22. Similarly, elements 27, 28 are bent upwardly by bending element 27 along the line 92 between elements 27, 21. In addition, element 28 is bent along the line 94 between elements 27, 28, and since elements 27, 28 have already been bent upwardly in the previous step, this results in element 28 being bent inwardly so that it extends in the direction along the line 96 between elements 21, 22 towards element 25.

Element 26 is bent upwardly along the line 98 between elements 26, 23, and this is done similarly with element 29, which is bent upwardly along the line 100 between elements 29, 23. Element 23 is then bent upwardly along the line 102 between elements 23, 22, and after that element 22 is bent upwardly along the line 96 between elements 21, 22. Accordingly, elements 21, 23 are now arranged in parallel planes with element 22 extending upwardly and connecting these two elements, and the rear faces of elements 25, 28 are now arranged immediately in front of the front face of element 22. The rear faces of elements 25, 28 are then glued to the front face of element 22 to form one side wall of the container.

Also, the rear face of element 24 extends immediately in front of the front face of element 26 and is glued thereto to form one short side wall of the container. Gluing is performed, however, only over about half the width of elements 24, 26 in the portions close to element 21, so that the upper half of the short side wall remains unglued and a small gap is left between the unglued portions. Similarly, the rear face of element 27 extends immediately in front of the front face of element 29 and is glued thereto to form the other short side wall of the container.

Next, elements 34, 35, 37 are bent upwardly and element 32 is bent upwardly along the line 104 between elements 32, 21. Also, element 33 is bent along the line 106 between elements 33 and 32. It includes a flexible portion 36 the function of which will be explained further below.

Elements 34, 35 which have less than half the width of portions 24, 26 and 27, 29 are then introduced into the respective gaps formed which have remained between elements 24, 26 and 27, 29, that is to say between the unglued portions of the short side walls. Accordingly, during introduction of elements 34, 35 between these unglued portions and during further movement of element 33, elements 34, 35 are guided along the respective side wall of the container. Element 37 which forms a flap that is laterally attached at one side to element 32 forming the other side wall, is introduced into the interior of the container such that its rear surface abuts against the front surface of element 24 of one of the short side walls. Finally, the function of flap 30 and of cut-out 31 will be described below.

The container can be filled with smoking articles, e.g. cigarettes. To open the container for removing a cigarette the consumer may grasp and hold flap 30 (shown in FIG. 5) and in addition with his forefinger he may grip element 33 at cut-out 31. The consumer then moves element 33 outwards, however, only to an extent that the side to which flap 37 is attached always remains closed, that is to say flap 33 is not fully pulled out of the interior of the container. In this open position of the container, a prismatic space closed on one side is formed into which a cigarette may roll upon inclining the container accordingly. Thus, when the container is suitably held the cigarette may not fall out of the prismatic space due to the lateral flap 37 not having been fully pulled out of the interior of the container. If the container is then inclined towards that side opposite to the laterally attached flap 37, the cigarette may then come out of the prismatic space and can be grasped by the consumer.

Figure 5:
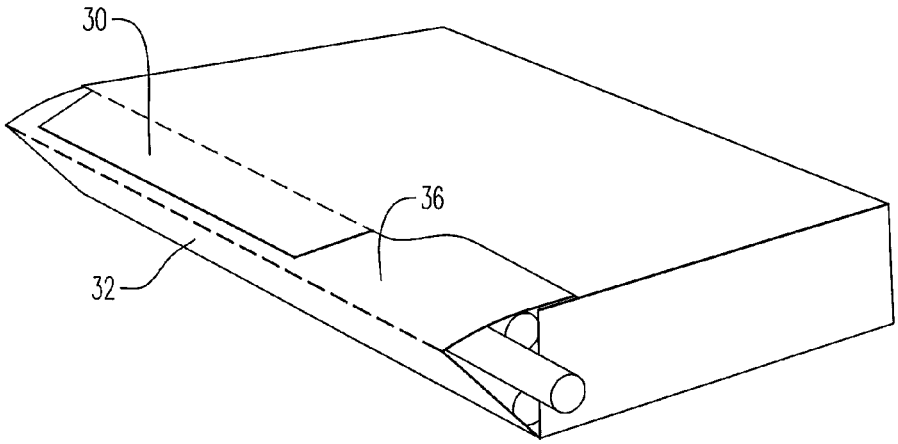
FIG. 5 shows a perspective view of the second embodiment of the container in its open state, after the cardboard has been cut, folded and glued.

This open position of the container where the cigarette can be taken out by the consumer is shown in FIG. 5, which also shows the prismatic space already referred to above. The formation of this prismatic space is possible because the flexible portion 36 including the plurality of bending lines enables the flexible bending of this portion 36 of the container. Once the cigarette has been pulled out by the consumer, the container may be reclosed by moving element 33 back.

Accordingly, from FIG. 4 and FIG. 5 it can be seen that after folding and gluing of the cardboard shown in FIG. 1 element 23 forms the front wall of the container while element 21 forms the back wall of the container. Elements 27, 29 together form the top wall and elements 24, 26 together form the bottom wall of the container. One of the side walls is formed element 22 whereas the other side wall which is pivotally attached to back wall 21 is formed by a continuous side wall portion 32. Element 37 forms the flap which is laterally attached to the continuous side wall portion 32 at the lateral end thereof. Elements 33, 36 form the extension portion which, together with the continuous side wall portion 32, form the pivotally attached side wall. The laterally attached guiding elements 34, 35 are internally guided as the extension portion is pivotally moved from the closed to the open position or vice versa along the top wall and the bottom wall. Flap 30 allows for a more convenient holding of the container while cut-out 31 facilitates grabbing and moving of the extension portion in order to obtain a smoking article from the interior of the container.

Figure 6:
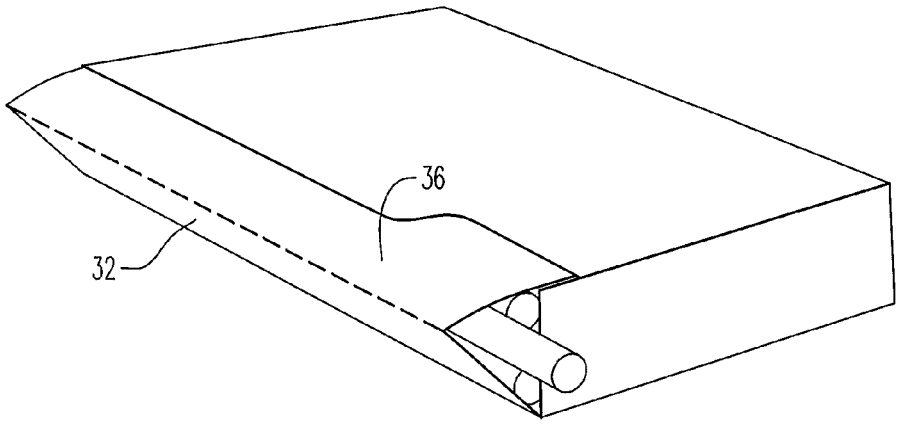
FIG. 6 shows a perspective view of a third embodiment of the container which is similar to the embodiment shown in FIG. 5.

In yet another embodiment of the container, which is very similar to that described above, with the aid of FIG. 4 and FIG. 5, is shown in FIG. 6. The container shown in FIG. 6 essentially differs from that one shown in FIG. 4 and FIG. 5 only in that flap 30 is not present. While this embodiment does not allow the consumer to grasp the flap, the container is still convenient to handle and can be opened and reclosed in the above-described manner for taking out a cigarette or other smoking article and then reclosing the container.

Having described embodiments of the container according to the invention, it is obvious for the person skilled in the art that various changes and modifications are possible without departing from the general teaching of the invention. In particular, it is to be noted that while the container has been disclosed as being particularly suitable for smoking articles such as cigarettes, it can also be used for consumer goods other than smoking articles. Therefore, the invention is not limited to the embodiments described but rather is defined by the appended claims.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred container and method of making with reference to a specific embodiment thereof, it will be apparent to one skilled in the art that various changes and modifications may be made to the container and equivalents method may be employed, which do not materially depart from the spirit and scope of the invention. Accordingly, all such changes, modifications, and equivalents that fall within the spirit and scope of the invention as defined by the appended claims are intended to be encompassed thereby.

I claim:

1. A container for consumer goods comprising:

a front wall;

a back wall;

a top wall;

a bottom wall; and two side walls, wherein one of the said two side walls is pivotally attached to one of the back wall and the front wall of the container and is capable of being moved between an open position and a closed position, wherein the side wall which is capable of being moved includes separate first and second side wall portions which are separated from one another in a manner such that each of the first and second side wall portions includes approximately half of the side wall, and wherein the other one of the said two side walls is fixedly attached to one of the front wall and the back wall of the container, wherein the first side wall portion is provided with a retaining means allowing the second side wall portion to remain in the closed position, and wherein the second side wall portion includes an extension portion which is located towards the inside of the container and which is pivoted together with the second side wall portion, so as to extend into the interior of the container and allow a smoking article to come to lie thereon as the second side wall portion is in the closed position, and moves the smoking article during pivoting of the second side wall portion from the closed position to the open position thus releasing the smoking article from the interior of the container.

2. The container of claim 1, wherein the first side wall portion includes an overlapping cut-out portion and a back wall portion arranged behind the cut-out portion so that the interior of the container is fully closed when the second side wall portion is in the closed position.

3. The container of claim 1, wherein the side wall which is capable of being moved is adapted to allow only one single smoking article at a time to be released from the interior of the container.

4. The container of claim 1, wherein the container is formed of a single, rigid piece of cardboard or of a laminar material or the like.

5. The container of claim 1, wherein the container contains smoking articles.

* * * * *